US006861953B2

(12) United States Patent
Deconinck et al.

(10) Patent No.: US 6,861,953 B2
(45) Date of Patent: Mar. 1, 2005

(54) SECURITY DEVICE HAVING A RELEASABLE ELECTRONIC CONNECTION

(75) Inventors: Joseph Deconinck, West Babylon, NY (US); Dominick Dimonda, Seaford, NY (US); Brendan Regan, Smithtown, NY (US)

(73) Assignee: Protex International Corp., Bohemia, NY (US)

( * ) Notice: Subject to any disclaimer, the term of this patent is extended or adjusted under 35 U.S.C. 154(b) by 121 days.

(21) Appl. No.: 10/217,848

(22) Filed: Aug. 13, 2002

(65) Prior Publication Data

US 2004/0032329 A1 Feb. 19, 2004

(51) Int. Cl.[7] ..... G08B 13/12

(52) U.S. Cl. ..... 340/568.2; 340/572.1; 340/568.1

(58) Field of Search ..... 340/568.2, 572.1–572.9, 340/548, 568.1, 568.4, 571

(56) References Cited

U.S. PATENT DOCUMENTS

| | | | | |
|---|---|---|---|---|
| 3,932,857 A | | 1/1976 | Way et al. | 340/280 |
| 4,746,909 A | | 5/1988 | Israel et al. | 340/568 |
| 4,935,725 A | | 6/1990 | Turnau | 340/568 |
| 5,072,213 A | | 12/1991 | Close | 340/572 |
| 5,172,098 A | | 12/1992 | Leyden et al. | 340/568 |
| 5,543,782 A | | 8/1996 | Rothbaum et al. | 340/568 |
| 5,561,417 A | | 10/1996 | Rothbaum et al. | 340/568 |
| 5,565,848 A | | 10/1996 | Leyden et al. | 340/572 |
| 5,604,484 A | * | 2/1997 | Rogers | 340/568.8 |
| 5,689,237 A | * | 11/1997 | Sasagawa et al. | 340/572.8 |
| 5,796,337 A | | 8/1998 | Wachsman | 340/568 |
| 5,821,857 A | | 10/1998 | Rand | 340/568 |
| 5,986,562 A | * | 11/1999 | Nikolich | 340/693.5 |
| 5,995,003 A | | 11/1999 | Rogers | 340/568.4 |
| 6,050,616 A | | 4/2000 | Evans | 292/111 |
| 6,067,014 A | | 5/2000 | Wilson | 340/540 |
| 6,104,289 A | | 8/2000 | Rand | 340/568.4 |
| 6,147,603 A | | 11/2000 | Rand | 340/568.2 |
| 6,215,400 B1 | | 4/2001 | Rand et al. | 340/568.2 |
| 6,278,365 B1 | | 8/2001 | Kane et al. | 340/531 |
| 6,285,283 B1 | | 9/2001 | Rand et al. | 340/568.2 |
| 6,300,874 B1 | | 10/2001 | Rand | 340/568.2 |
| 6,317,046 B1 | * | 11/2001 | Fresnel et al. | 340/572.9 |
| 6,353,389 B1 | * | 3/2002 | Matsuo | 340/571 |
| 6,570,502 B2 | * | 5/2003 | Matsuo | 340/568.2 |
| 6,677,852 B1 | * | 1/2004 | Landt | 340/10.1 |

OTHER PUBLICATIONS

Product Theft Deterrence Ltd pp (1–2) Publication Date Dec. 14, 2001.

Product Theft Deterrence Ltd pp (1–3) Publication Date Dec. 14, 2001.

Se–Kure Controls (Canada), Inc pp–1–12 see pp 8 Jan. 29, 2002.

* cited by examiner

*Primary Examiner*—Phung Nguyen
(74) *Attorney, Agent, or Firm*—Collard & Roe, P.C.

(57) ABSTRACT

A security device that is attachable to a surface of display items. The security device includes a housing comprising a sensor body having a flat face plate, and a jack housing, and a dome shaped cover which is attachable to the flat face plate. Jack housing is attachable or molded to an inside face of the flat face and extends out from that inside face with an opening in the dome shaped cover forming an opening for the jack. Disposed on an outside surface of this flat face plate is an adhesive opposite the open port connection of the jack. The adhesive functions as a fastener, fastening the security device to the display device. To determine whether the security device has been detached from the display device, there is a switch disposed substantially in the housing. The switch is in contact with the surface of the item for display, so that when said housing is detached from the item for display, the switch triggers a signal, indicating that the device has been removed from the item for display. Because the port connection is disposed opposite the adhesive flat face, a user can easily pick up an item being displayed while it is still electronically connected to a central station.

16 Claims, 7 Drawing Sheets

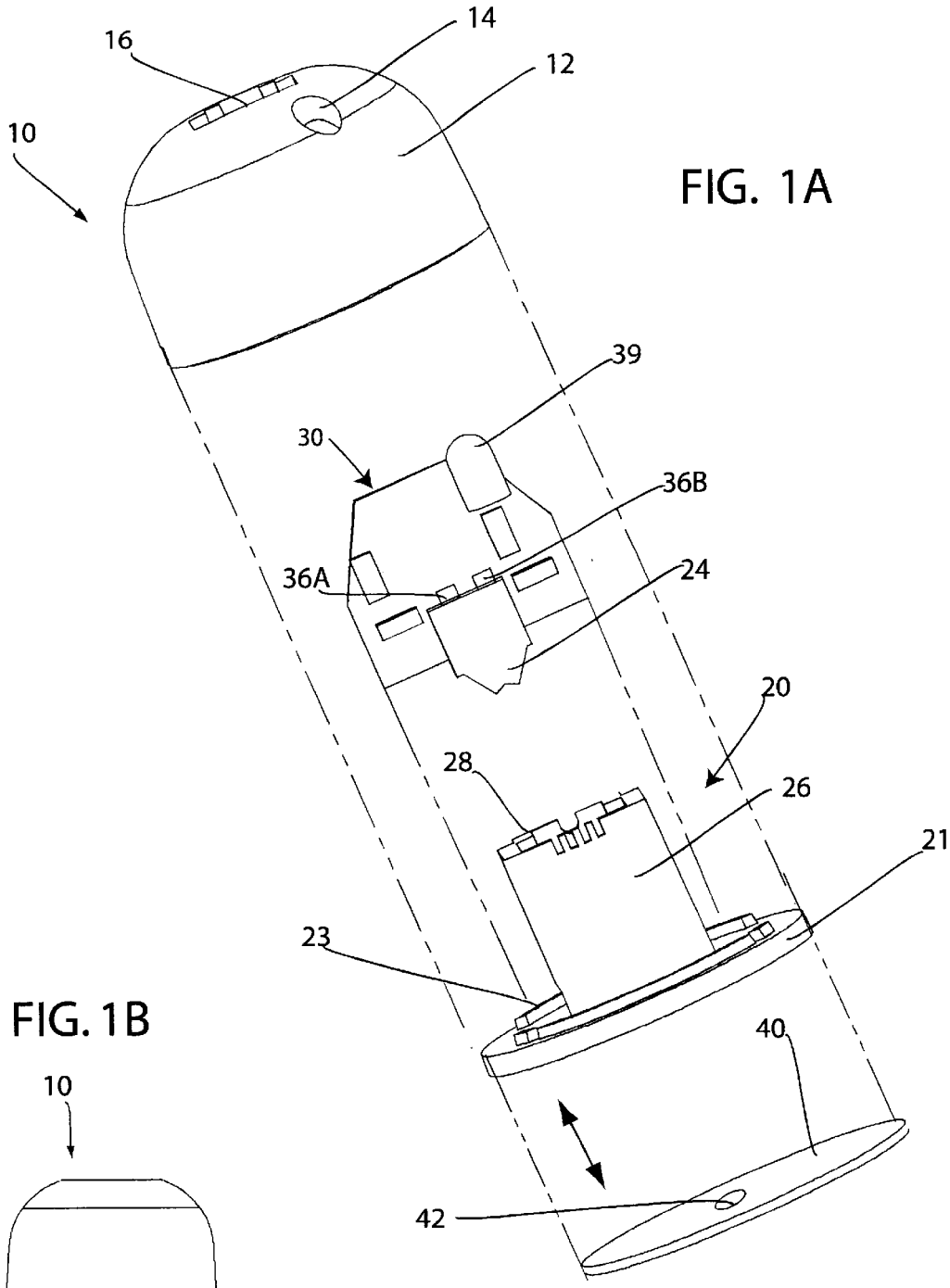
FIG. 1A
FIG. 1B
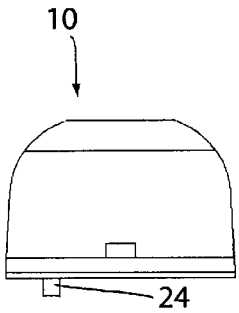

SECURITY DEVICE HAVING A RELEASABLE ELECTRONIC CONNECTION

BACKGROUND

The invention relates to a sensor or security device that has a releasable connection. This releasable connection can be in the form of a plug connection such as a telephone jack connection. The sensor can work with central security systems or other sensors described in U.S. Pat. Nos. 6,300,874; 6,285,283; 6,278,365; 6,215,400; 6,147,603; 6,104,289; 6,050,616; 5,821,857; 5,796,337; 5,561,417; 5,543,782 all assigned to Protex International Corp. and all incorporated herein by reference.

SUMMARY

The invention relates to a security device that is attachable to a surface of an item on display. The security device includes a housing comprising a dome shaped cover, which is attachable to a sensor body. The sensor body contains a flat face plate and a security cable or telephone jack. The telephone jack extends out from an inside face of the flat face plate and is disposed inside the housing lining up with an opening in the dome cover opposite an outside face of the flat face plate.

Coupled to an outside surface of this flat face plate is an adhesive. The adhesive functions as a fastener fastening the security device to the item on display.

To determine whether the security device has been detached from the display device, there is a switch disposed substantially in the housing. The switch, which can be a lever switch, a snap switch or a micro-switch, is in contact with the surface of the item for display, so that when the housing is detached from the item for display, the switch triggers a signal, indicating that the device has been removed from the item for display.

In other embodiments of the invention, the switch can be an optical switch or any other style switch, while the adhesive can be any form of fastener, and the housing can be of any suitable shape. Essentially, all of the embodiments of the invention embody a design of a releasable electrical security connection disposed opposite a face that attaches to an item to be displayed. Thus, with items for display such as hand-held organizers or cameras, this security device can be coupled to a back face of the item so that when a user pulls the item for display out from a back face, the residual tension and direction from a security line is directed along the same or a substantially similar axis to the direction the user is pulling. Other models do not allow for easy handling of the item on display because if the residual tension and direction from the security line extended along an axis that is different from the axis that the user was pulling, the item on display may rotate or create a torque force in the user's hand leading to unequal forces on the object and an uneasy handling of items on display.

This electronic sensor can be attached to a remote security system via a security cable. The system can be manufactured to be "supervised", "non-supervised" or "EPA". In the supervised configuration, the system is constantly monitoring the sensor. If someone attempts to bypass, short, sever or tamper with the electro-mechanical switch (EMS) or cabling, this will interrupt the current running through the system and thus tamper with the system, the sensor will detect this interference by registering a change in the voltage, and sound the alarm. In the non-supervised configuration, the alarm will sound only if the connection to the control unit is severed or if the EMS is deactivated. The "EPA" configuration is a two wire system. This configuration will also sound an alarm if the connection to the control unit is severed or if the switch (EMS) is reactivated.

BRIEF DESCRIPTION OF THE DRAWINGS

Other objects and features of the present invention will become apparent from the following detailed description considered in connection with the accompanying drawings, which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 1A is an exploded view of a security device;

FIG. 1B is a side view of the device of FIG. 1A coupled together;

DETAILED DESCRIPTION

Figure 2A:
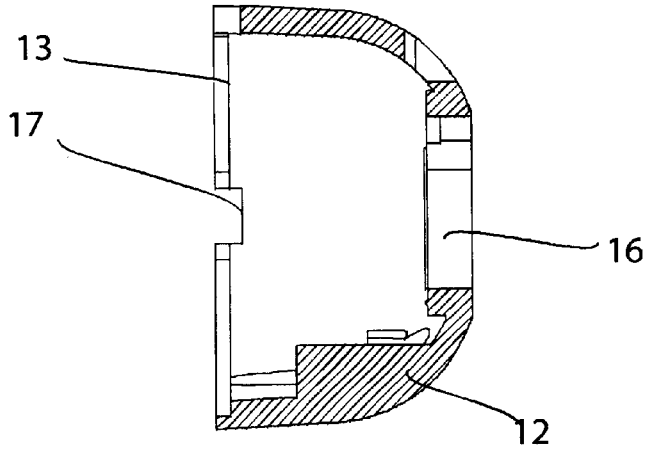
FIG. 2A is a side cross sectional view of the cover shown in FIG. 1A.

Referring in detail to the drawings, FIG. 1A shows an exploded perspective view of the device, wherein device 10 comprises four main components: a cover 12, which is dome shaped, a sensor body 20, which can be coupled to cover 12, a circuit board 30 which fits with sensor body 20 inside cover 12 and an adhesive 40 which adheres to an outside face of sensor body 20. FIG. 1B shows the device of FIG. 1A coupled together with a switch lever 24 extending there-through.

Figure 2B:
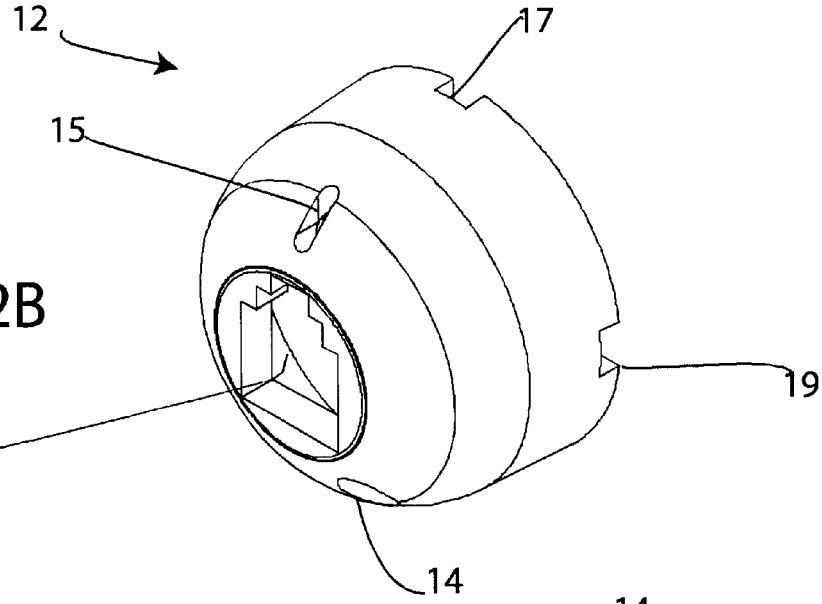
FIG. 2B is an outside perspective view of the cover shown in FIG. 2A.
Figure 2C:
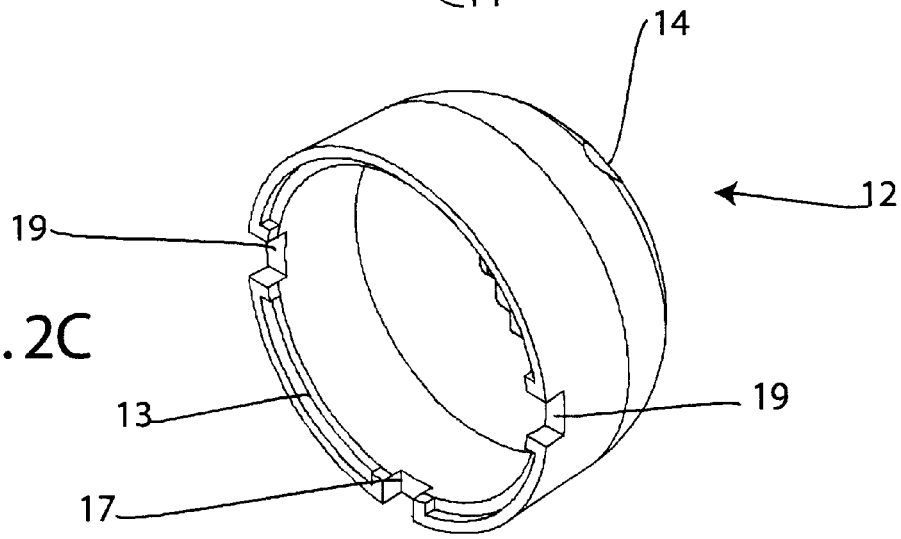
FIG. 2C is an inside perspective view of the cover shown in FIG. 1A.

As shown in greater detail in FIGS. 2A, 2B, and 2C, cover 12 has a centering recess 13, which allows dome shaped cover to be centered on a flat plate. Cover 12 also has a first hole 14, which allows an LED light to fit there-through. There is also a second hole 16, which provides an opening for a telephone jack.

Cover 12 also contains an access hole 15 for plug-latch disengagement, wherein a cable plug (See FIG. 2B) can be released from device 10 when a user inserts a pin, a bent paperclip or another elongated object into access hole 15 to press down on a cable latch of a security cable.

There is also notch 17 which is cut or molded into cover 12 which allows cover 12 to align onto protrusion and mating detail 27 (See FIG. 3A) on flat face plate 21. Cover 12 also contains two tie wrap holes 19 either cut or molded into cover 12. Tie wrap holes 19 allow a tie wrap 50 (See FIGS. 6A and 6B) to slide through cover 12 to secure device 10 to an item on display.

Figure 3A:
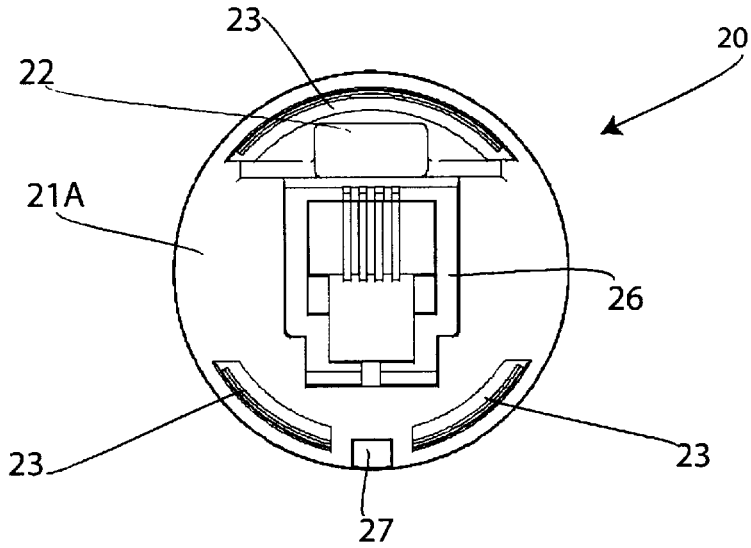
FIG. 3A is a back view of a sensor body shown in FIG. 1A.
Figure 3B:
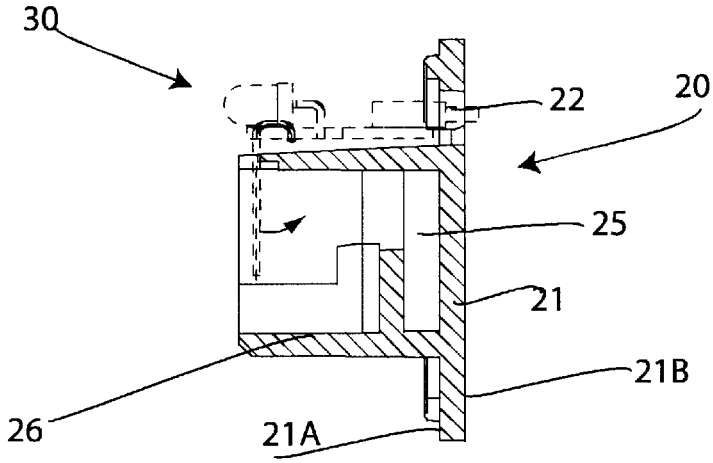
FIG. 3B is a side cross sectional view of the sensor body shown in FIG. 3A.
Figure 3C:
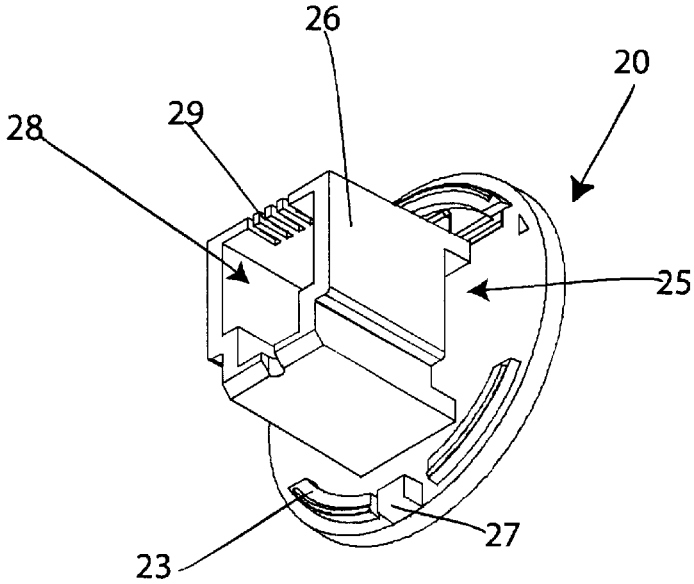
FIG. 3C is a back perspective view of the sensor body shown in FIG. 3A.

FIGS. 3A, 3B, and 3C show sensor body 20 in greater detail wherein flat face plate 21 contains an inside face 21A and an outside face 21B. Extending through plate 21 is a hole 22 (See FIG. 3A) which allows a switch lever 24 to extend there-through to a surface of a device for display. Extending out from inside face 21A is an intermittently broken centering ring 23 which aligns with and compliments centering recess 13, to line up dome 12 with sensor body 20. In addition, notch 17 also aligns with protrusion 27 extending out from inside face 21A. Dome 12 and flat plate 21 are secured together either with an adhesive, or with sonic welding. If sonic welding is used, the coupling of protrusion 27 and centering ring 23 with notch 17 and centering recess 13 creates a three-dimensional interference fit between dome 12 and flat plate 21 to allow for a stronger sonic weld.

In addition, extending out from inside face 21A is a telephone jack housing 26 for receiving wire leads. An open end of jack housing 26 forms a jack interface 28 with lead slots 29 disposed therein. A security cable and plug in the form of a telephone line can then be coupled into interface 28 through hole 16 in dome 12 This security cable and plug can then extend into a central security station such as that shown in U.S. Pat. No. 6,104,289. The central security station sends a signal through to jack interface 28 so that when this security cable and jack interface 28 are decoupled, the security line is compromised, or when the device is removed from the display item, an alarm is triggered in the central security station.

FIGS. 3B and 3C show a bridge section 25 wherein jack housing 26 is bridged over inside face 21A of flat plate 21. Dome housing 12 and flat plate 21 align so that tie wrap holes 19 line up with bridge section 25. Tie wrap holes 19 and bridge section 25 create a channel across inside face 21A so that a tie wrap (See FIGS. 6A and 6B) can be inserted around flat plate 21. This tie wrap can then wrap around an item on display. In addition FIG. 3B shows a representation of circuit board 30 shown with dashed lines, coupled with sensor body 20.

Figure 4A:
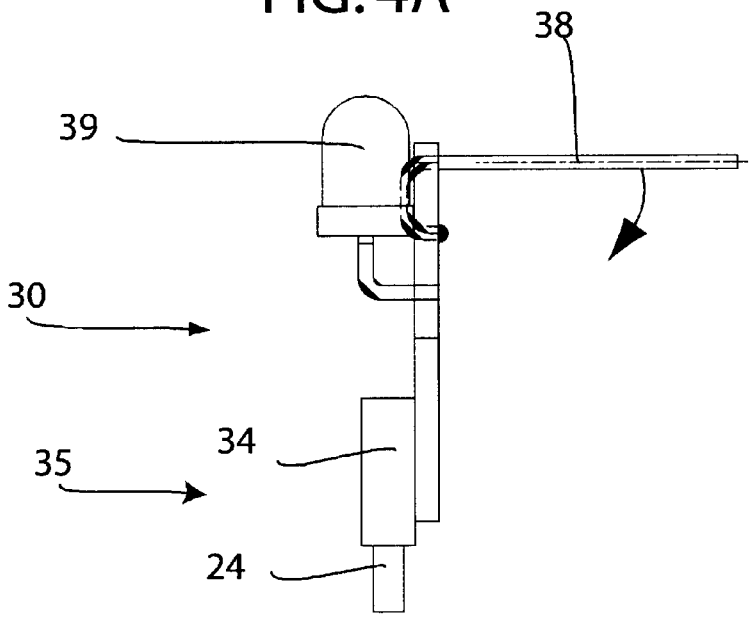
FIG. 4A is a side view of the circuit board shown in FIG. 1A.
Figure 4B:
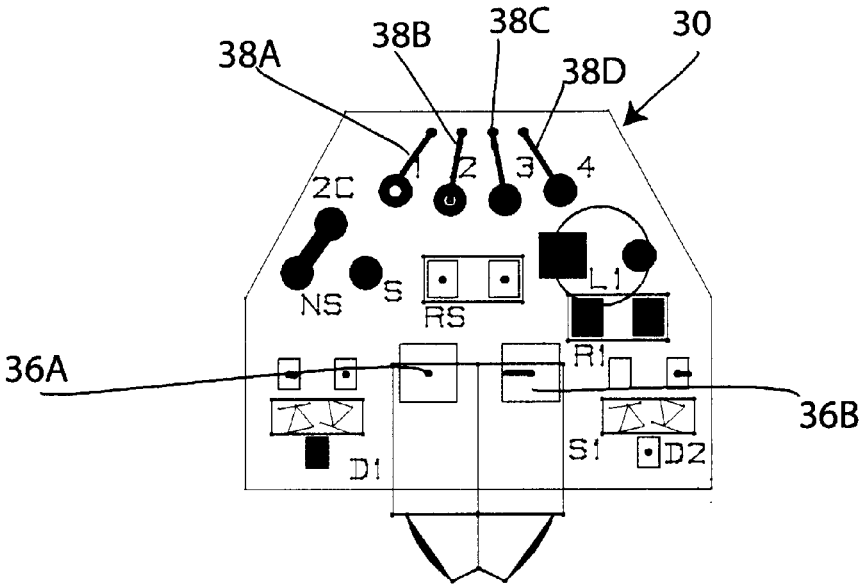
FIG. 4B is a detailed view of the printed wiring assembly shown in FIG. 4A.

FIGS. 4A and 4B, show an electronic component body or circuit board 30 in greater detail. Electronic component body 30 contains a switch housing 34, which couples with switch lever 24 to form an electro-mechanical switch (EMS) 35. Switch lever 24 is spring loaded inside of switch housing 34. When switch lever 24 is pushed inside switch housing 34, this action closes a circuit for an electro-mechanical switch (EMS) 35 (See FIG. 5B). The closed circuit would then relay back to a base station that device 10 is connected to an item for display when device 10 is coupled to a security cable. While only one type of switch has been shown, this security device is not limited to a single type switch. Any type switch known in the art can be used inside of this housing.

As shown in FIGS. 4A and 4B there are a plurality of leads 38, which, when the components of device 10 are coupled together, are formed around jack housing 26. As shown by the arrow in FIG. 3B, leads 38 snap down inside lead slots 29 on jack housing 26 when a cable plug is placed inside jack housing 26. These leads 38 remain bent on an angle thereafter to easily receive a plug into jack housing 26.

Figure 5A:
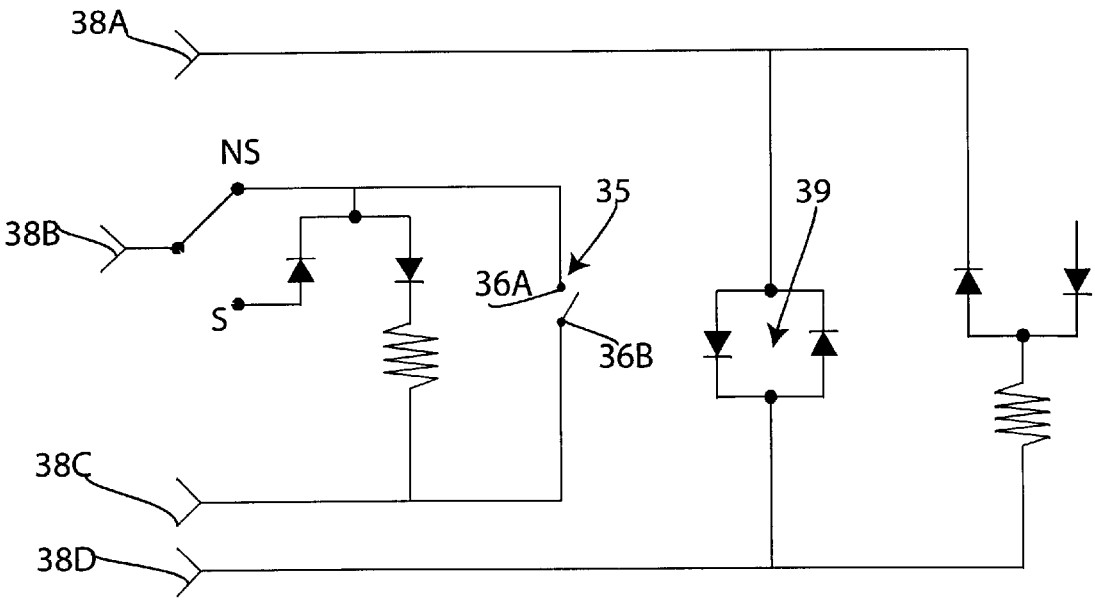
FIG. 5A is a schematic circuit diagram of a non-supervised type circuit on the circuit board shown in FIG. 4A in an open state.
Figure 5B:
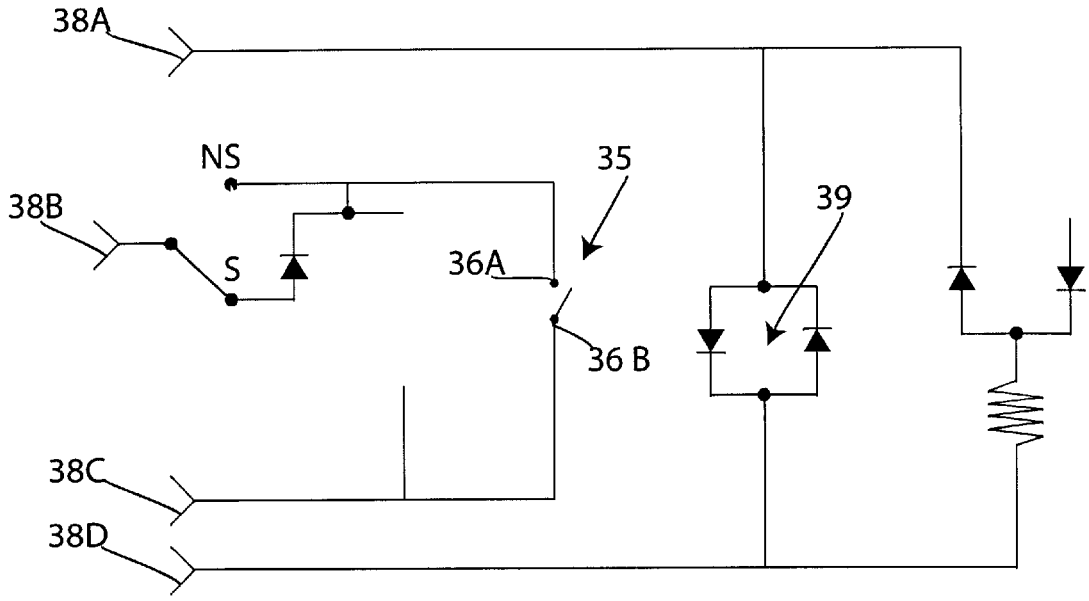
FIG. 5B is a schematic diagram of a supervised type circuit.

FIGS. 5A and 5B are schematic diagrams of a circuit showing leads 38A, 38B, 38C and 38D. Leads 38A and 38D are electrically connected to each other and are also coupled to a first set of two lines on a security cable so that they form a continuous electronic loop with an alarm base station. A second set of two lines in the security cable couple to leads 38B and 38C which extend into contacts 36A and 36B which then lead into switch 35. When the security cable is attached to device 10 and switch 35 is closed, leads 38B and 38C and the second set of lines of the security cable form a continuous loop with an alarm base station.

As long as the security cable remains intact, coupled to the device, and device 10 remains pressed on the item on display with the switch closed, one or more signals sent from the alarm base station can pass through device and back to the base station resulting in no alarm. The first set of lines in the security cable electrically coupled to leads 38A and 38D form a circuit to detect whether the security cable is present. Once the security cable has been cut, the circuit opens, causing the base station to signal an alarm. In addition, the second set of lines in the security cable, coupled to leads 38B and 38C, form a circuit to detect whether device 10 has been removed from an item on display. If a user removes device 10 from the item on display, switch lever 24 springs open back through the housing, opening switch 35, causing the circuit to open and triggering the alarm back in the central base station.

As shown in FIGS. 5A and 5B, the base station and the device form a system that can be manufactured to be "supervised" or "non-supervised". In the supervised configuration, as shown in FIG. 5B, with a line connecting line 38B with contact S, the base station is constantly monitoring the sensor device. If someone attempts to bypass, short, sever or tamper with the electro-mechanical switch (EMS) 35 or cabling, this will interrupt the current running through the system and thus tamper with the system, the sensor will detect this interference through registering a change in the voltage, and sound the alarm. In the non-supervised configuration, as shown in FIG. 5A, with a line connecting line 38B with contact NS, the alarm will sound only if the connection to the control unit is severed or if the EMS 35 is deactivated.

Electronic component body 30 also contains a LED or light 39 which can either light up or change color when EMS 35 is activated. This light can be in the form of a green light if there is no alarm triggered and then switch to a red light if the alarm is triggered.

Figure 5C:
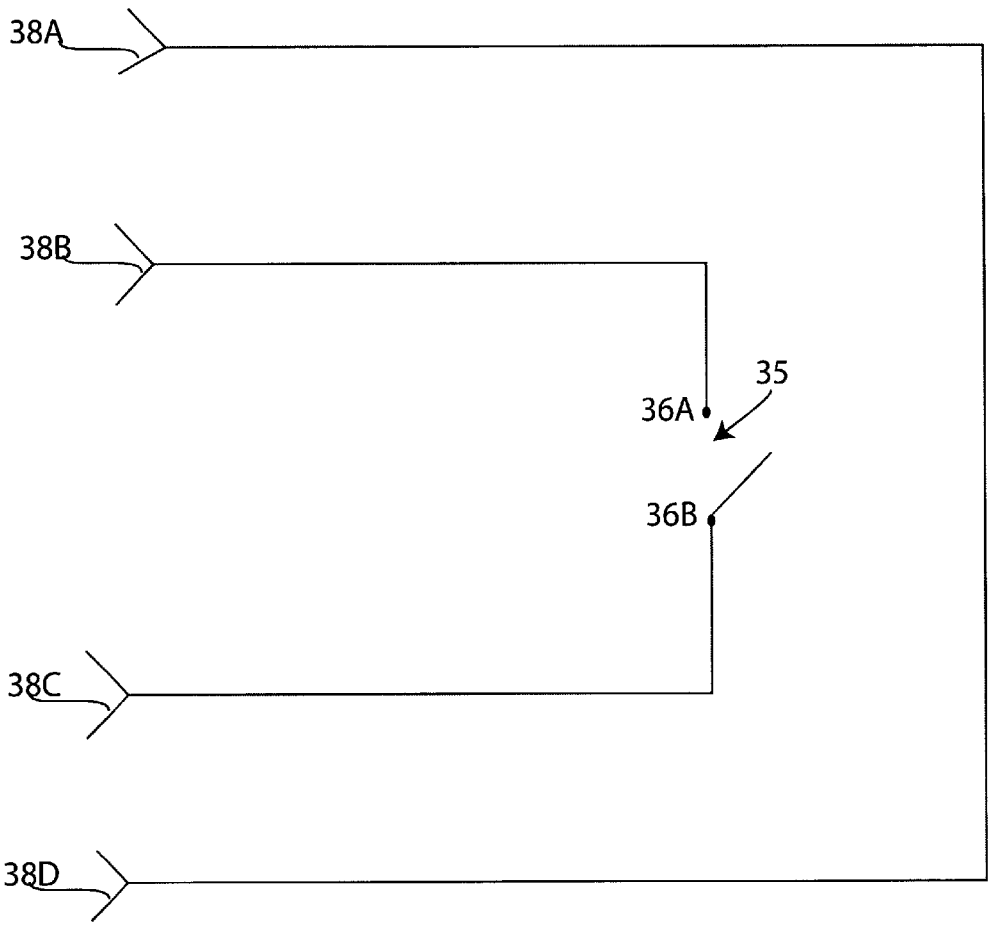
FIG. 5C is a schematic diagram of an EPA type circuit.

FIG. 5C is another configuration of the invention wherein this configuration is a two wire configuration having shows four connections 38A, 38B, 38C, and 38D. Disposed between connections 38B and 38C is a switch 35 which is between contacts 36A and 36D. This type system is used for "soft goods" such as garments and clothing. This system is explained in greater detail in U.S. Pat. No. 5,561,417 incorporated herein by reference. As with the other designs, upon the unauthorized removal of the sensor, the cutting of the item cable, or upon a similar security breach, such as the breaking of a closed circuit, or the deactivation of the EMS, the alarm will sound.

Figure 6A:
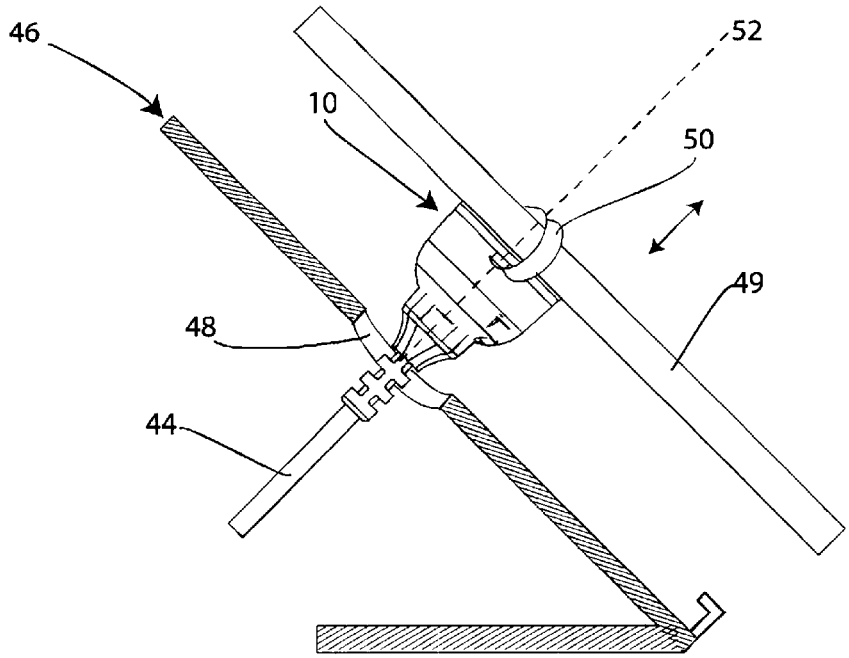
FIG. 6A is a side view of the sensor device being coupled to an item on display.
Figure 6B:
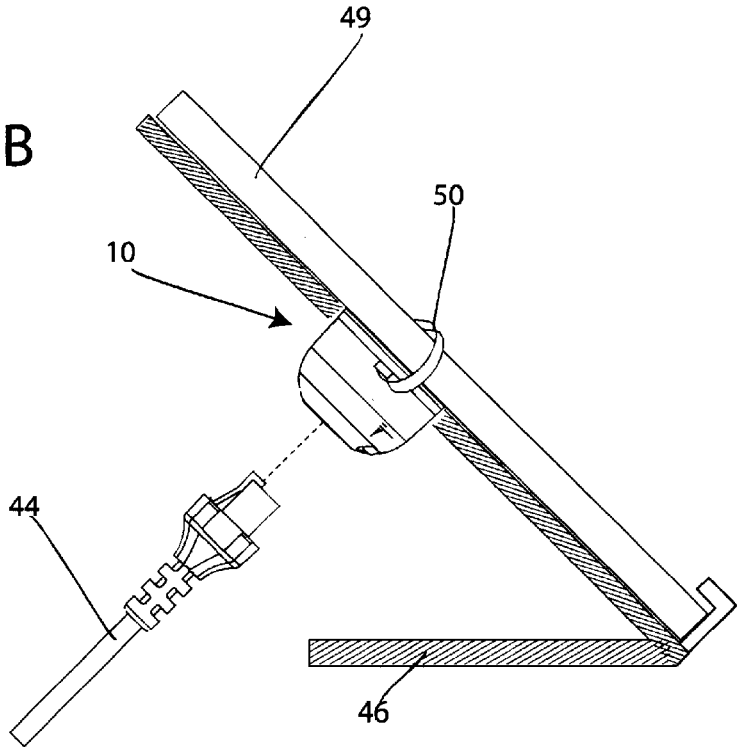
FIG. 6B is a side view of the sensor coupled to the item on display while the item on display is resting on a stand.

FIG. 6A shows device 10 already coupled via adhesive 40 to an item on display 49 at one end and to a security cable 44 at another end. Because of the circular cross section of dome 12 (See FIG. 2A) on device 10, it can fit snugly within a display 46, shown in a cross sectional view, having an access hole 48. FIG. 6B shows device 10 coupled to an item on display 49 wherein device 10 fits inside of access hole 48. There is also a tie wrap 50, which fits through holes 19 and bridge 25 coupling device 10 to item on display 49. As shown in FIG. 6B, security cable can be selectively decoupled from device 10 even after device 10 is coupled to item 49.

The design of device 10 is unique because adhesive 40 coupled to outside surface 21B of flat face plate 21 is opposite a releasable connection with cable 44. As shown in FIG. 1A, adhesive 40 is a disc shaped body, which can contain an adhesive on both sides. One side of adhesive 40 adheres to outside surface 21B while the opposite side of adhesive 40 can be coupled to item on display 49. As shown in FIG. 1A, adhesive 40 contains a hole 42 which allows switch lever 24 to fit there-through. While this adhesive can be in the form of a double-sided tape, other embodiments may include any other type adhesive or fastening means known in the art.

In all of these embodiments, flat adhesive face 40, with switch lever 24 extending out therefrom, is disposed opposite jack interface 28. This design allows users to easily pick up and handle an item on display. FIG. 6A shows a view of an item on display 49 as it is pulled away from display 46.

Because this port opening in the form of jack interface 28 and second hole 16 is disposed opposite the adhesive face 40, the tension and direction on cable 44 is directed along dash dotted line 52 in a manner substantially perpendicular to the plane of the connection surface. Thus, with items for display such as hand held organizers or cameras, this security device can be coupled to a back face of item 49 so that when a user grabs onto the side faces of the item and pulls item 49 out from display unit 46, the residual tension and direction from cable 44 is directed along the same or a substantially similar axis to the direction the user is pulling. This tension can be created by a strain relief, which spring loads a security cable inside of a cable housing. Ultimately, this type of connection is free from many of the offset or torque forces which may be associated with previous designs that have a security cable extending parallel to a connection surface.

Accordingly, while at least one embodiment of the present invention has been shown and described, it is to be understood that many changes and modifications may be made thereunto without departing from the spirit and scope of the invention as defined in the appended claims.

What is claimed is:

1. A security device that is attachable to a security cable at one end and a surface of a display item at another end, the device comprising:

a) housing having a flat contact surface;

b) a releasable electrical connection disposed in said housing opposite said flat contact surface, said releasable electrical connection for connecting to the security cable;

c) an adhesive disposed on said flat contact surface wherein said contact surface is for contacting an adjacent display item; and d) a switch disposed substantially in said housing, wherein said switch is in contact with the surface of the display item when the device is attached to the display item wherein the security cable can be releasably secured to said releasable electrical connection.

2. The device as in claim 1, wherein said housing is dome shaped.

3. The device as in claim 1, wherein said housing comprises two components, a cover and a sensor body, wherein said cover and said sensor body can be connected together.

4. The device as in claim 3, wherein said sensor body further comprises a centering ring and said cover contains a corresponding centering recess wherein said centering recess on said cover mates with said centering ring or said sensor body when said cover and said sensor body are coupled together.

5. The device as in claim 3, wherein said sensor body further comprises a protrusion and said cover further comprises a notch for mating with said protrusion when said cover and said sensor body are coupled together.

6. The device as in claim 4, wherein said cover and said sensor body are coupled together via sonic welding.

7. The device as in claim 1, wherein said switch is an electro-mechanical switch.

8. The device as in claim 1, further comprising an LED display disposed on said housing and electrically coupled to said switch, wherein when said LED displays a color coded light when said switch is opened.

9. A security sensor in communication with an alarm base station via a security cable, the security sensor being attachable to a surface of display items and comprising:

a) a housing comprising:

i) a sensor body including a flat face plate and a cable jack for releasably coupling to a cable disposed inside said housing, said cable jack having an open end facing opposite an outside face of said flat face plate wherein said flat face plate and said cable jack are coupled together to form a tie wrap channel; and ii) a substantially dome shaped cover which is attachable to said sensor body;

c) a switch disposed substantially in said housing; and d) an adhesive disposed on said outside surface of said flat face plate wherein said adhesive attaches the device to the item for display so that said switch is in contact with a surface of the item for display, wherein when said housing is detached from the item for display the switch indicates that the device has been removed from the item for display.

10. The device as in claim 9, wherein said dome shaped cover includes a hole for allowing a security cable to connect to said cable jack.

11. The device as in claim 9, wherein said dome shaped cover includes an access hole for allowing access to a latch on a security cable to selectively release said security cable (44) from said cable jack.

12. The security sensor as in claim 9, wherein said security sensor is attached to said security cable and wherein said security sensor is designed as a non-supervised sensor and further comprises a diode-resister combination coupled in parallel with said switch, wherein the alarm will sound only if the connection to the control unit is severed or if the EMS 35 is deactivated.

13. The security sensor as in claim 9, wherein the security sensor is attached to the security cable and wherein the security sensor is designed as a supervised sensor with the alarm base constantly monitoring the sensor device and triggers an alarm back at the alarm base if there is a change in voltage across the security cable.

14. The security senior as in claim 9, wherein the security sensor is attached to the security cable and wherein the security cable comprises at least two wires.

15. A security sensor in communication with an alarm base station via a security cable, the security sensor being attachable to a surface of display items and comprising:

a) a sensor body including a flat face plate and a cable jack for releasably coupling to a cable said cable jack disposed inside said housing, said cable jack having an open end for receiving the security cable facing opposite an outside face of said flat face plate, said cable jack having a plurality of lead slots, wherein said flat face plate and said cable jack are coupled together to form a tie-wrap channel, and b) as substantially dome shaped cover which is attachable to said sensor body said dome shaped cover having at least one opening for receiving the security cable;

c) a circuit board comprising:

i) a plurality of electrical leads;

ii) a first circuit which is coupled to a first set of at least two leads of said plurality of electrical leads and forming a closed circuit with said first set of said at least two leads;

iii) a second circuit including a second set of at least two leads of said plurality of leads; and a switch, having a switch leg spring loaded to the circuit board, wherein said switch is coupled to said second set of at least two leads, which can selectively open and close said second circuit;

iv) a light electrically coupled to said plurality of leads; and d) an adhesive disposed on said outside surface of said flat face plate;

wherein said circuit board is coupled to said sensor body via said plurality at leads inserting into said plurality of load slots, with said spring leg inserting through a hole on said flat face plate and wherein said substantially dome shaped cover is sonic welded to said sensor body, covering said circuit board, and wherein said adhesive attaches the device to the item for display so that said switch leg is in contact with a surface of the item for display, wherein when said housing is detached from the item for display, the alarm base station sounds an alarm and said light changes color.

16. The device as in claim 1, further comprising a tie wrap which fits through a hole in the housing and which is for coupling the indicating means to the item on display.

* * * * *